United States Patent [19]

Hall, Jr.

[11] 4,062,638

[45] Dec. 13, 1977

[54] TURBINE WHEEL WITH SHEAR CONFIGURED STRESS DISCONTINUITY

[75] Inventor: Beuford C. Hall, Jr., Indianapolis, Ind.

[73] Assignee: General Motors Corporation, Detroit, Mich.

[21] Appl. No.: 723,802

[22] Filed: Sept. 16, 1976

[51] Int. Cl.[2] ..... F01D 5/02

[52] U.S. Cl. ..... 416/244 A; 416/213 R

[58] Field of Search ..... 416/244 A, 244 R, 213 R, 416/193 A

[56] References Cited

U.S. PATENT DOCUMENTS

| | | | |
|---|---|---|---|
| 3,255,994 | 6/1966 | Dreimanis | 416/244 A |
| 3,262,674 | 7/1966 | Huebner et al. | 416/244 A |
| 3,262,675 | 7/1966 | Huebner et al. | 416/244 A |
| 3,262,676 | 7/1966 | Huebner | 416/244 A |

*Primary Examiner*—Everette A. Powell, Jr.
*Attorney, Agent, or Firm*—J. C. Evans

[57] ABSTRACT

An integrally cast turbine blade and wheel assembly has a plurality of circumferentially spaced radially outwardly directed blades on a peripheral rim that is connected by a wheel web to a central hub having a bore therethrough. The assembly includes a plurality of circumferentially spaced, pairs of grooves to define a plurality of weakened sections in the wheel rim and web that will selectively crack in shear to relieve stresses during either a tensile or compressive phase of wheel assembly operation produced during thermal cycling of an associated engine; and wherein resultant stress relief cracks define a labyrinth seal path to control gas bypass across the blade row.

3 Claims, 6 Drawing Figures

TURBINE WHEEL WITH SHEAR CONFIGURED STRESS DISCONTINUITY

This invention relates to integrally cast turbine blade and wheel assemblies and more particularly to such blade and wheel assemblies having geometric discontinuities therein for shear formation of stress relief cracks to avoid excessive stress build-up in the wheel assembly during thermal cycling of an associated engine.

It is well recognized that the rims of integrally cast turbine blade and wheel assemblies are subjected to substantial strain cycling due to thermal conditions of engine operation including the steps of engine fire-up; stabilization during an equilibrium run phase of operation; and engine cool down or shut-off. All of these phases of engine operation include increasing and decreasing thermal sequences in the turbine blade and wheel assemblies. Such thermal sequencing induces high tangential compressive strain in wheel rim fibers of the assembly during initial engine fire-up. The high tangential compressive strain is due to the rapid heating of the wheel rim relative to the wheel web and central bore of the integrally cast turbine blade and wheel assembly.

Various proposals have been suggested wherein there is a provision for slots or geometric discontinuities in the rim of such integral blade and wheel assemblies to prevent excess wheel stress. For example, one such arrangement is set forth in U.S. Pat. No. 3,262,676 issued July 26, 1966, to Huebner, Jr., et al. In such arrangements and as shown diagrammatically in FIG. 8 of the U.S. Pat. No. 3,262,676, the geometric discontinuity for stress relief is produced only when tensile strain is produced on the wheel rim fibers. Such tensile strain conditions occur during engine shut-down but not on engine start-up where combustion fire-up produces substantial compressive forces.

A further suggestion for weakening an integral turbine wheel rim is set forth in U.S. Pat. No. 3,817,657 issued June 8, 1974, to Hueber. In this proposal the wheel rim includes a plurality of axial holes therethrough and a plurality of associated radial rim slots to define weakened sections for failure under conditions where the rim fibers are placed in tension to pull the rim apart at the slots. The axial holes have a tubular insert located therein to prevent gas bypass of the blades on the turbine wheel upon the occurrence of structural interruptions in the wheek rim.

An object of the present invention is to improve integrally cast turbine blade and wheel assemblies of the type subjected to severe strain cycling upon thermal sequence events in normal engine operation by the provision of a geometric discontinuity having a configuration including a shear segment for crack generation in shear in response to either tensile or compressive strain in the rim fibers of the blade and wheel assembly.

Still another object of the present invention is to improve integrally cast turbine blade and wheel assemblies by the provision of a geometric discontinuity in the wheel rim having a configuration to produce a rim crack in shear under both tensile or compressive phases of strain in the rim and wherein the discontinuity is configured with parallel shear displacement components to produce a minimum leak path for gas bypass of blades.

Yet another object of the present invention is to improve integrally cast turbine blade and wheel assemblies of the type having a peripheral wheel rim thereon joined to a central hub by means of a wheel web segment and including a plurality of integrally formed, radially outwardly directed blades thereon by the provision of a plurality of circumferentially spaced pairs of slots with one slot being located on the outer radius of the wheel rim and the other of the pair of slots being located on the inner radius of the wheel rim to define a radially extending shear segment in which a shear crack will occur under either tensile or compressive strain on the rim fibers thereby to provide a weakened sectin for a structural interruption path in the rim of the wheel assembly during either tensile or compressive action on the wheel rim produced during either engine start-up or shut-down; and wherein the radially outwardly directed shear segment, when interrupted, defines a minimum leak path for controlling gas bypass through the blades.

Still another object of the present invention is to provide an improved integrally cast turbine blade and wheel assembly including a wheel rim, a wheel web and central hub segment thereon with a plurality of integrally formed blades directed radially outwardly thereof and wherein the wheel includes a plurality of circumferentially spaced, axially directed openings adjacent the wheel rim and disc with each opening being enclosed on one side by a wheel web segment formed integrally between the outer wheel rim and the wheel disc by the provisions of a first pair of grooves formed in the web segment to define a radially extending shear segment that will fail in response to either excessive tensile or compressive strain produced upon either engine start-up or shut-down and by the further provision of a second pair of grooves formed in the rim to define a shear segment responsive to either excessive tensile strain or compressive strain on the wheel rim fibers during either fire-up or engine shut-down and wherein each of the pairs of grooves are offset on either side of their respective shear segments to define a reduced minimum leak path for gas bypass of the blade rows during engine operation.

Further objects and advantages of the present invention will be apparent from the following description, reference being had to the accompanying drawings wherein a preferred embodiment of the present invention is clearly shown.

Figure 1:
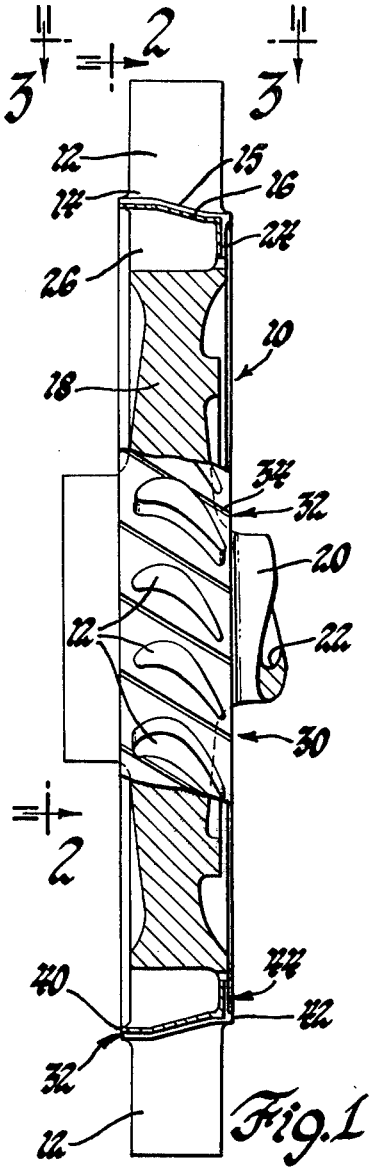
FIG. 1 is a view in vertical section of an integrally cast blade and wheel assembly in accordance with the present invention.
Figure 2:
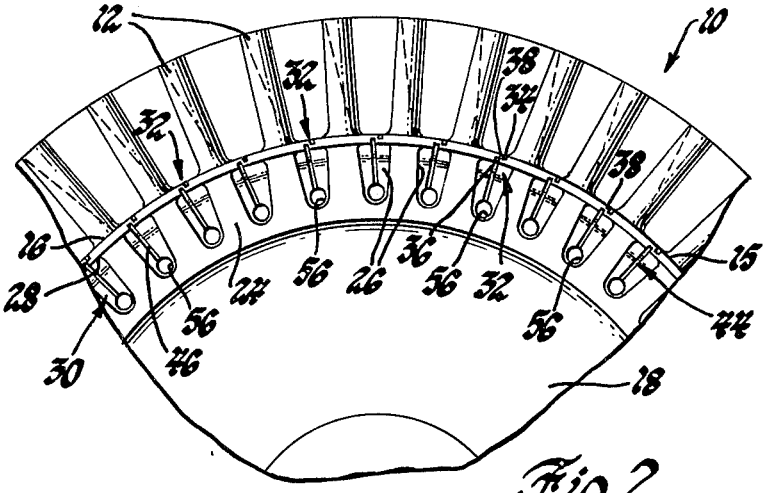
FIG. 2 is a fragmentary end elevational view taken along the line 2—2 of FIG. 1 looking in the direction of the arrows.

Referring now to the drawings, in FIG. 1, an integrally cast turbine blade and wheel assembly 10 is illustrated. It is a single stage turbine impeller configuration which is used in association with gas turbine engines of the type set forth in U.S. Pat. No. 3,490,746, issued Jan. 20, 1970, to A. H. Bell III.

Such gas turbine engines include a combustor which is fired at the start of engine operation to produce an increase in engine temperature from ambient levels to an elevated temperature condition in the order of 1600° F as a representative turbine inlet temperature.

After the initial fire-up phase of operation, the temperature of the engine stabilizes at a normal elevated operating temperature and the wheel assembly 10 is in thermal equilibrium. Engine operation further includes a cool down thermal phase whenever the engine is shut-down or the engine is driven without fuel flow thereto. The cool down phase of operation is characterized by a change in temperature of the wheel assembly from the elevated operating temperature range to ambient temperature conditions.

The blade and wheel assembly 10 includes a plurality of integrally formed, radially outwardly directed circumferentially spaced blades 12 thereon which are located downstream of a nozzle assembly for directing combustion gases against the wheel assembly 10. Each of the blades 12 includes a root segment 14 that is formed integrally in a smooth transition to the outer diameter 15 of a circumferentially formed outer peripheral, wheel rim 16. In the illustrated arrangement the wheel rim 16 is connected to a wheel disc 18 having a central hub 20 thereon with a bore 22 therethrough for receiving an operating shaft driven by the wheel assembly as combustion gases are directed thereacross. In the illustrated arrangement the wheel disc 18 is joined to the wheel rim by a wheel web 24 that constitutes one end of a plurality of axial cavities 26 formed in the wheel disc 18 at circumferentially spaced points around the outer periphery thereof and radially inboard of an inner diameter 28 on the wheel rim 16.

During the fire up phase of operation the wheel rim 16 is rapidly heated as compared to the wheel web and disc 18 of the assembly 10. This imposes high tangential compressive strain on wheel rim fibers during start-up. Such compressive strain diminishes as the wheel thermally stabilizes during continued operation. Under the engine shut down condition wherein the engine is operated with fuel off, the wheel rim fibers are subjected to a more rapid thermal cooling response than occurs at the wheel web and disc segments of the assembly. Accordingly, a substantial tensile strain is produced in the same wheel rim fibers.

The aforesaid conditions are not as severe in loose bladed wheel assemblies since such arrangements include gaps between the blades and wheel fasteners that produce a sufficient number of structural interruptions to accommodate both the substantial increases in either tangential compressive strain or tensile strain action on the wheel rim fibers.

In the past, it has been proposed that a weakened geometric discontinuity be provided in the vicinity of the wheel rim of integral blade and wheel assemblies to prevent the strain condition from exceeding the strength of the wheel assembly. However, in such arrangements the slots are configured to produce a structural interruption to relieve stress build-ups only during a phase of operation wherein rim fibers are subjected to tensile strain.

Figure 3:
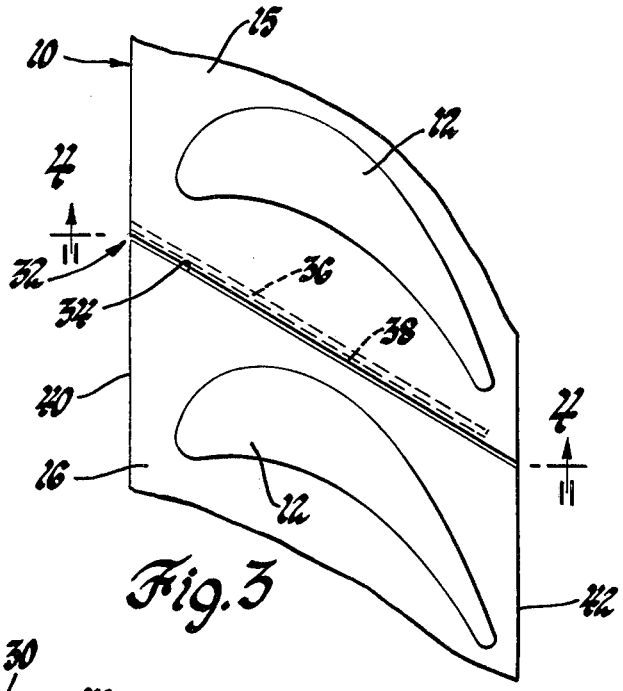
FIG. 3 is an enlarged, fragmentary top elevational view taken along the line 3—3 of FIG. 1 looking in the direction of the arrows.
Figure 4:
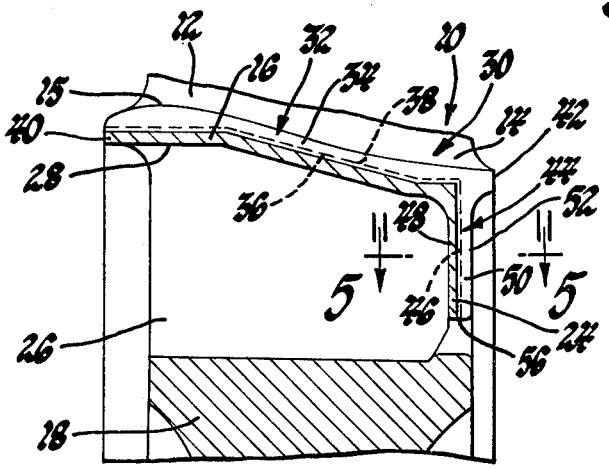
FIG. 4 is a vertical sectional view taken along the line 4—4 of FIG. 3 looking in the direction of the arrows.

In accordance with the principles of the present invention an improved plurality of circumferentially spaced geometric discontinuities 30 are provided in the wheel assembly 10 to produce stress relief structural interruptions in the wheel assembly during both engine fire up phases wherein the wheel rim fibers are subjected to elevated compressive forces and engine shutdown phases of operation wherein the wheel rim fibers are subjected to substantial tensile strain. To accomplish this objective each of the circumferentially spaced, geometric discontinuites 30 on the wheel assembly 10 include a first pair of slots 32 on the wheel rim 16. Each pair of slots 32 includes a first slot 34 formed across the width of the outer diameter 15 of the wheel rim 16 and a second slot 35 formed across the width of the inner diameter 28 of the wheel rim 16 as best seen in FIG. 3. The first and second slots 34, 36 are spaced apart from one another and are separated by a shear segment 38 extending axially from the upstream edge 40 to the downstream edge 42 of the wheel rim.

Figure 5:
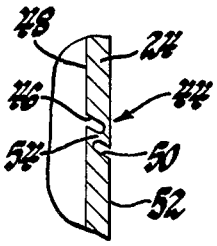
FIG. 5 is a horizontal cross sectional view taken along the line 5—5 of FIG. 4 looking in the direction of the arrows.

Each of the geometric discontinuities 30 further includes a second pair of slots 44 formed at circumferentially spaced points along the wheel web 24. Each of the pair of slots 44 includes a first slot 46 formed in the upstream surface 48 of the web 24 and a second slot 50 formed in the downstream wall 52 of the web 24 as shown in FIG. 5. The first and second slots 46, 50 have a shear segment 54 formed therebetween that extends radially of the web 24 to define a second section in the wheel assembly that will fail under excessive strain (either tensile or compressive) conditions to prevent failure of the blade and wheel assembly during thermal sequencing thereof as produced by normal engine operation.

Each of the pair of slot 44 are associated with a radially inboard hole 56 to prevent migration of structural interruptions that are produced at the geometric discontinuities 30 for passing radially inboard of the wheel assembly 10 thereby to maintain structural integrity of the wheel assembly following structural interruption in response to both compressive and tensile compressive forces acting on the structural fibers at the wheel rim 16.

By virtue of the provision of the plurality of pairs of slots 32, 44 generation of stress relief cracks occur under both tensile or compressive forces on the wheel rim to provide the desired relief of strain during both engine fire-up and cool-down phases of operation. The separation occurs as a shear line through segments 38, 54.

Figure 6:
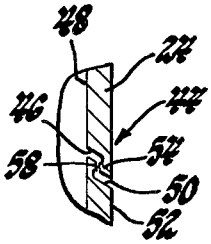
FIG. 6 is like FIG. 5 showing a structural interruption as produced by the present invention.

As shown in FIG. 6, a crack 58 is generated in shear because of the invention. This crack orientation results in a labyrinth type passage at each of the cracked shear segments 54 in the web 24. Like cracks will occur in each of the shear segments 38 in the wheel rim 16. The resultant crack orientation results in a minimum area leakage path to reduce gas bypass of the row of blades 12 on the assembly 10 since the parallel shear displacement which cracks the shear segments 38, 54 will not increase the leakage gap as is the case where adjacent pieces of metal are pulled apart by tensile forces thereon.

Additionally, the reduced ultimate strength of material when subjected to shear as opposed to tensile or compressive loading also will produce a structure interruption crack in the wheel assembly at lower wheel web and bore stress levels than heretofore obtainable.

While the embodiments of the present invention, as herein disclosed, constitute a preferred form, it is to be understood that other forms might be adopted.

The embodiments of the invention in which an exclusive property or privilege is claimed are defind as follows:

1. An integrally cast turbine wheel assembly comprising an annular, continuously formed wheel rim, a wheel disc integrally connected to said rim and extending radially inwardly thereof, a plurality of blades formed integrally of said rim and extending radially outwardly thereof, a web segment on said disc, means including a first pair of grooves formed in said web segment for defining a radially extending structural discontinuity through said web segment, said radially extending structural discontinuity having a segment thereon that will break apart in response to tangential compressive strain in said disc for relief thereof, means including a second pair of grooves formed in said rim for defining an axially extending structural discontinuity in said rim, said axially extending structural discontinuity having a segment that will break apart in response to tangential compressive strain in said rim for relief thereof.

2. An integrally cast turbine wheel assembly comprising an annular, continuously formed wheel rim, a wheel disc integrally connected to said rim and extending radially inwardly thereof, a plurality of blades formed integrally of said rim and extending radially outwardly thereof, a side web segment on said disc, a first pair of grooves formed in said web segment to define a radially extending shear segment through said web segment, a second pair of grooves formed in said rim to define an axially extending shear segment, said shear segments being responsive to either tensile or compressive phases of strain cycling of said wheel assembly to produce a structural interruption both axially of said rim and radially of said web for stress relief, said pairs of grooves being offset on either side of said shear segments to define a labyrinth flow path at said structural interruption to minimize gas bypass around said blades.

3. An integrally cast turbine wheel assembly comprising an annular, continuously formed wheel rim, a wheel disc integrally connected to said rim and extending radially inwardly thereof, a plurality of blades formed integrally of said rim and extending radially outwardly thereof, said disc having a plurality of circumferentially spaced, axially extending recesses therein, a side web segment on said disc at one end of each of said recesses, a first pair of grooves formed in said web segment to define a radially extending shear segment in said web segment, a second pair of grooves formed in said rim to define an axially extending shear segment, said shear segments being responsive to either tensile or compressive phases of strain cycling of said wheel assembly to produce a structural interruption both axially of said rim and radially of said web for stress relief, said pairs of grooves being offset on either side of said shear segments to define a labyrinth flow path at said structural interruption to minimize gas leakage axially around said blades.

* * * * *